US007414597B2

(12) United States Patent
Choi et al.

(10) Patent No.: US 7,414,597 B2
(45) Date of Patent: Aug. 19, 2008

(54) PLASMA DISPLAY PANEL DRIVING CIRCUIT

(75) Inventors: Hak-Ki Choi, Cheonan (KR); Sang-Chul Kim, Cheonan (KR); Seung-Pil Mun, Cheonan (KR); Kwang-Ho Jin, Cheonan (KR); Sun-Kyung Ahn, Asan (KR)

(73) Assignee: Samsung SDI Co., Ltd., Suwon (KR)

( * ) Notice: Subject to any disclaimer, the term of this patent is extended or adjusted under 35 U.S.C. 154(b) by 740 days.

(21) Appl. No.: 10/769,786

(22) Filed: Feb. 3, 2004

(65) Prior Publication Data

US 2004/0183753 A1 Sep. 23, 2004

(30) Foreign Application Priority Data

Mar. 18, 2003 (KR) ..... 10-2003-0016852

(51) Int. Cl.
*G09G 3/28* (2006.01)

(52) U.S. Cl. ..... 345/60; 345/41; 345/42; 345/62; 345/63; 345/204; 313/582; 313/586; 315/169.4

(58) Field of Classification Search ..... 345/60–72, 345/88–104, 33, 41, 42
See application file for complete search history.

(56) References Cited

U.S. PATENT DOCUMENTS

| | | | | |
|---|---|---|---|---|
| 3,970,896 | A * | 7/1976 | Marino | 315/387 |
| 4,029,937 | A * | 6/1977 | Russell | 392/318 |
| 6,249,087 | B1 * | 6/2001 | Takayama et al. | 315/169.1 |
| 6,937,213 | B2 * | 8/2005 | Iwasa et al. | 345/60 |

* cited by examiner

*Primary Examiner*—Richard Hjerpe
*Assistant Examiner*—Jennifer T Nguyen
(74) *Attorney, Agent, or Firm*—H.C. Park & Associates, PLC

(57) ABSTRACT

A PDP driving circuit for a stable operation of a ramp pulse. A capacitor having a temperature characteristic opposite to a temperature characteristic of a part coupled to a switch that operates as a constant current source for generation of a ramp pulse is arranged in the driving circuit for generating a ramp pulse. The ramp pulse linearly increases or decreases a panel voltage of the PDP with respect to time. Parts having opposite temperature characteristics are coupled in parallel to control variation of a gradient of the ramp pulse so that values of the parts may not be varied depending on the temperature changes. Thus, stable operation of the ramp pulse is obtained.

12 Claims, 10 Drawing Sheets

PLASMA DISPLAY PANEL DRIVING CIRCUIT

CROSS REFERENCE TO RELATED APPLICATION

This application claims priority to and the benefit of Korea Patent Application No. 2003-16852 filed on Mar. 18, 2003 in the Korean Intellectual Property Office, the content of which is incorporated herein by reference.

BACKGROUND OF THE INVENTION (a) Field of the Invention

The invention relates to a PDP (plasma display panel) driving circuit for generating ramp pulses. More specifically, the invention relates to a PDP driving circuit for compensating for temperature variation of parts installed for generating ramp pulses, and allowing stable operation of the ramp pulses.

(b) Description of the Related Art

A PDP has a plurality of discharge tubes in a matrix pattern, and selectively has them emit to restore image data input as electrical signals.

FIG. 1 shows a PDP electrode arrangement diagram.

As shown, the PDP electrodes have an (m x n) matrix pattern. Generally, the m address electrodes A1 through Am are arranged in columns and the n scan electrodes Y1 through Yn and then sustain electrodes X1 through Xn are alternately arranged in rows. Hereinafter, the scan electrodes will be referred to as Y electrodes and the sustain electrodes as X electrodes. The reference numeral 12 in FIG. 1 represents a discharge cell.

In this instance, a number of respective electrodes on the PDP is determined according to its resolution. The PDP realizes gradation so as to output color display performance.

Realization of gradation on the PDP is executed, for example, by dividing one TV field into six subfields and performing time-division control on each of the subfields.

FIG. 2 shows a method for realizing gray sales in a PDP. As shown, the PDP divides a single TV field into six subfields to represent 6-bit grays, and each single subfield has an address interval and a sustain interval.

Current commercial PDPs generally have ten to twelve or more subfields in a single TV field rather than six subfields. Since an increase in the number of subfields in a PDP reduces the contour noise, which is an important factor of image quality, studies for increasing the number of subfields using various methods have been undertaken.

PDPs can use a ramp reset to obtain operational margins. When using a ramp reset to drive a PDP, wall charges are erased except the amount of wall charges that will be used for a subsequent address operation. Wall charges for a subsequent address are accumulated on the panel because of weak discharging, thereby allowing a low-voltage address operation.

FIG. 3 shows a PDP driving waveform using a ramp pulse, and FIG. 4 shows a PDP driving circuit for the driving waveform of FIG. 3. Dotted parts in FIGS. 3 and 4 respectively indicate a ramp pulse waveform and a simple ramp pulse generation part.

One of the methods for generating ramp pulses is by operating a switch of a driving circuit as a static current source so as to output ramp waveforms in the PDP modeled as a capacitive load.

When the voltage at the panel is set to be Vc, the voltage linearly increases with respect to the time axis in the case of a ramp pulse according to Equation 1. Accordingly, a differential value of Vc is a constant.

$$V_c = \frac{1}{C}\int i dt \qquad \text{Equation 1}$$

$$\frac{dV_c}{dt} = \frac{1}{C}\cdot i = \text{Constant}$$

In Equation 1, C is a capacitance of the panel. Because the capacitance value C is constant, in order to output a ramp pulse, the current (i) applied to the panel also needs to be constant.

FIG. 5 shows a ramp pulse generation circuit using a capacitor. As shown in FIG. 5, a capacitor C1 is arranged between a gate and a drain of an FET (field-effect transistor) to generate a ramp pulse. That is, in order to completely turn on the FET, it is required to charge a parasitic capacitance Cgs between the gate and the source of the FET, and to charge a parasitic capacitance Cgd between the gate and the drain thereof.

In this instance, when the capacitor C1 is added to the parasitic capacitance Cgd to charge the parasitic capacitance Cgs, a time frame from a time when the FET having a voltage greater than a threshold value starts being turned on to a time when the FET is completely turned on can be extended to some degree.

Accordingly, the parasitic capacitance Cgs is charged through a path ① to slightly open the FET, the gate current is applied to the panel through a path ②, and the charged parasitic capacitance Cgs is discharged to close the FET. In this instance, path ① and path ② cause a negative feedback effect to each other to allow the FET to operate as a constant current source.

FIG. 6 shows a ramp pulse generation circuit using a resistor. As shown in FIG. 6, a resistor $R_2$ is arranged between a source of the FET and a terminal Vs of a FET drive IC to generate a constant current source.

As shown in FIG. 5, when the gate current charges the parasitic capacitance Cgs to open the FET, the current Id starts flowing. The current Id charges the parasitic capacitance Cgd and steeply rises, but it generates a voltage drop of Vr at the resistor R2 to reduce the intensity of the voltage charged to the parasitic capacitance Cgs, because the potential difference between the terminal Vs of the FET drive IC and a terminal HO for outputting a gate signal has a constant voltage Vcc (generally about 12 to 18V).

When the voltage at Cgs reduces, the FET is closed to reduce the current Id. When the current Id reduces, the voltage drop Vr also reduces, and the voltage at Cgs increases to open the FET again.

The above-noted operation is a negative feedback effect to allow the FET to operate as a constant current source.

FIG. 7 shows gradients of the ramp pulse generated by the ramp pulse generation circuits in FIGS. 5 and 6.

When a switch on the PDP modeled as a capacitance load is operated using the constant current source, the ramp pulse shown in FIG. 7 is obtained.

In this instance, the gradients of the ramp pulse can be adjusted in the direction of arrow ① and arrow ② using resistor R1 and capacitor C1 of FIG. 5, and resistor R1 and resistor R2 of FIG. 6. The gradients of the ramp pulse increase or decrease depending on the time constants of parts and the surrounding temperatures, because the gradients depend on the temperature characteristics of the parts.

Application of the ramp pulse for execution of weak discharging in the PDP closely relates to the operational margin of the panel. When the gradient of the ramp pulse varies according to the surrounding temperature of the PDP, the discharging of the panel becomes unstable, and bad discharging occurs.

Therefore, it is required to maintain the gradient of the ramp pulse regardless of the surrounding temperature and other conditions so as to acquire stable discharging on the PDP.

SUMMARY OF THE INVENTION

The invention provides a PDP driving circuit for preventing gradient variation of a ramp pulse according to temperature changes to acquire a stable operation of the ramp pulse.

In one aspect of the invention, a PDP driving circuit for generating a ramp pulse for linearly increasing or decreasing a panel capacitor voltage of the PDP includes a transistor in which a parasitic capacitance is formed a negative feedback element coupled to the transistor, for performing negative feedback control on a voltage charged in the parasitic capacitance so that the transistor may operate as a constant current source; and a first capacitor coupled between a gate and an active node of the transistor. The first capacitor has a temperature characteristic opposite to the temperature characteristic of the negative feedback element.

In various exemplary embodiments of the invention, the negative feedback element comprises a second capacitor coupled between a gate and a drain of the transistor, and the first capacitor is coupled in parallel with the second capacitor between the gate and the drain of the transistor.

In various exemplary embodiments of the invention, the PDP driving circuit further comprises a third capacitor coupled between the gate and the source of the transistor. The third capacitor may have a temperature characteristic opposite to a temperature characteristic of a parasitic capacitance between the gate and the source of the transistor.

In various exemplary embodiments of the invention, the PDP driving circuit further comprises a third capacitor coupled between the gate and the drain of the transistor. The third capacitor has a temperature characteristic opposite that of a parasitic capacitance between the gate and the drain of the transistor.

In various exemplary embodiments of the invention, the negative feedback element comprises a resistor coupled to an output end of the transistor, and the first capacitor is coupled between the output end and the gate of the transistor.

In various exemplary embodiments of the invention, the PDP driving circuit further comprises a third transistor coupled in parallel to the parasitic capacitance of the transistor. The third transistor has a temperature characteristic opposite to a temperature characteristic of the parasitic capacitance.

In another aspect of the invention, a PDP driving circuit for generating a ramp pulse for linearly increasing or decreasing a panel capacitor voltage of a PDP is provided. The PDP driving circuit includes a transistor having parasitic capacitance being formed between a gate node and a source node thereof, a first capacitor coupled between the gate node and a drain node of the transistor, and a second capacitor coupled between the gate node and the drain node of the transistor, and having a temperature characteristic opposite that of the first transistor.

In another aspect of the invention, a PDP driving circuit for generating a ramp pulse for linearly increasing or decreasing a panel capacitor voltage of a PDP is provided.

The PDP driving circuit according to this aspect of the invention includes a transistor having parasitic capacitance formed between a gate node and a source node thereof, and a first capacitor coupled between the gate node and the source node of the transistor. The first capacitor has a temperature characteristic opposite that of the parasitic capacitance.

BRIEF DESCRIPTION OF THE DRAWINGS

The accompanying drawings, which are incorporated in and constitute a part of the specification, illustrate an exemplary embodiment of the invention, and, together with the description, serve to explain the principles of the invention.

DETAILED DESCRIPTION OF THE EXEMPLARY EMBODIMENTS

In the following detailed description, only exemplary embodiment of the invention has been shown and described, simply by way of illustration of the best mode contemplated by the inventor(s) of carrying out the invention. As will be realized, the invention is capable of modification in various obvious respects, all without departing from the invention. Accordingly, the drawings and description are to be regarded as illustrative in nature, and not restrictive.

Figure 8:
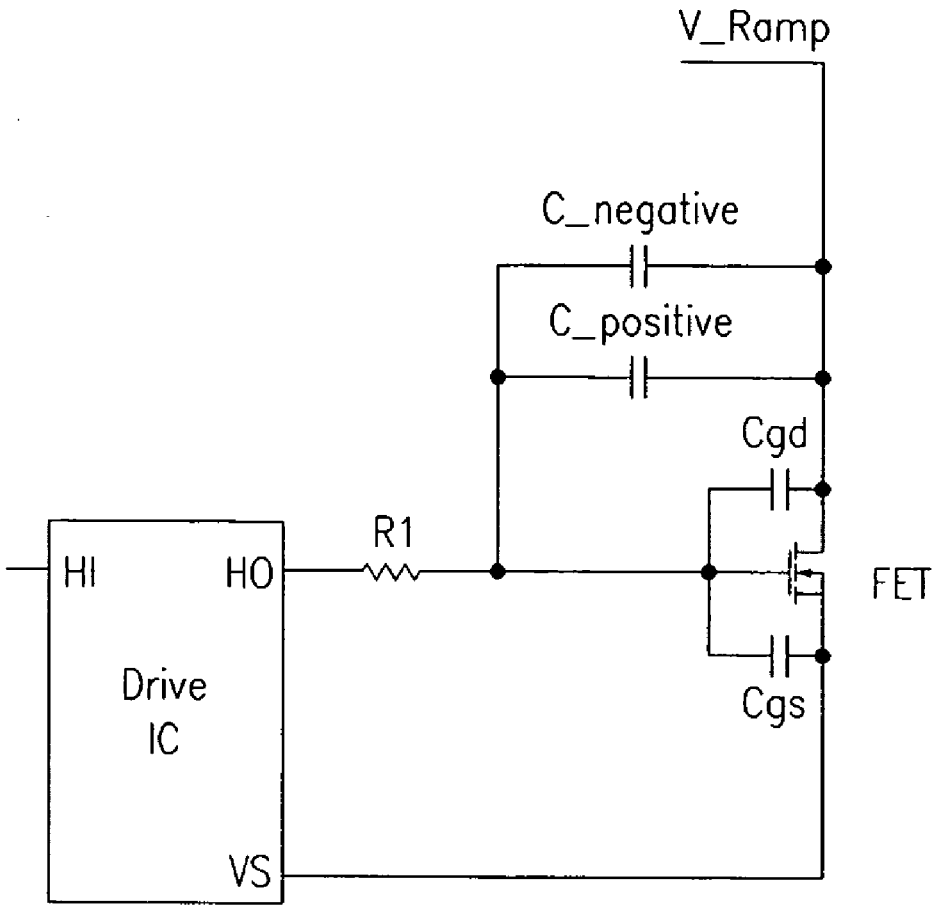
FIG. 8 shows a PDP driving circuit according to a first exemplary embodiment of the invention.

FIG. 8 shows a PDP driving circuit according to a first exemplary embodiment of the invention.

As shown in FIG. 8, capacitors C_negative and C_positive having opposite temperature characteristics are coupled in parallel between a gate and a drain of an FET operating as a constant current source. A ramp pulse for linearly increasing or decreasing a voltage at a panel capacitor in the PDP driving circuit is generated.

Parasitic capacitance is formed in the FET, and the capacitor C_negative is coupled to the FET and performs negative feedback control on the voltage charged in the parasitic capacitance so that the FET may operate as a constant current source. The capacitor C_positive is coupled between a gate node and an active node of the FET, and has temperature characteristics opposite those of the capacitor C_negative.

Figure 1:
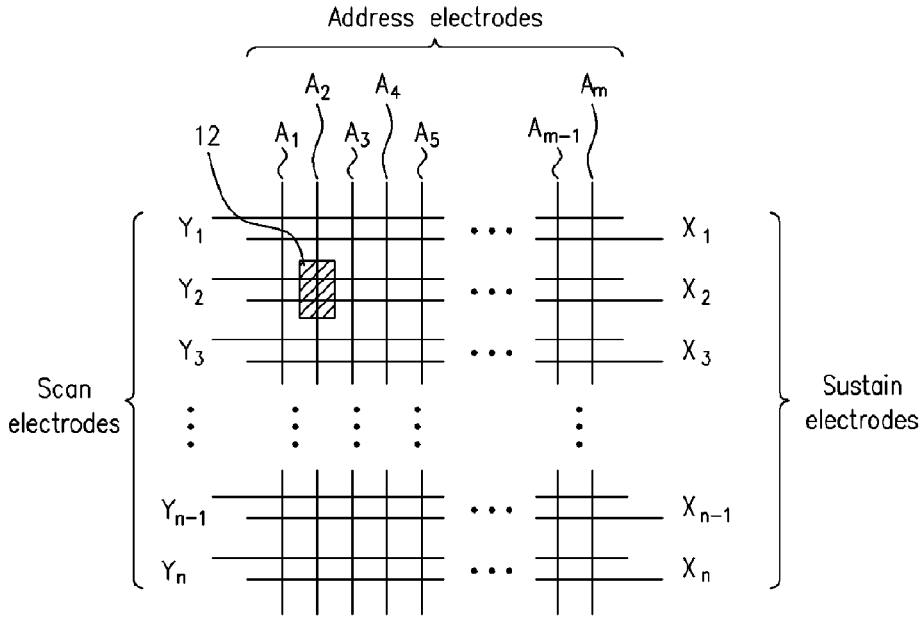
FIG.1 Conventional Art
FIG. 1 shows a PDP electrode arrangement diagram.
Figure 2:
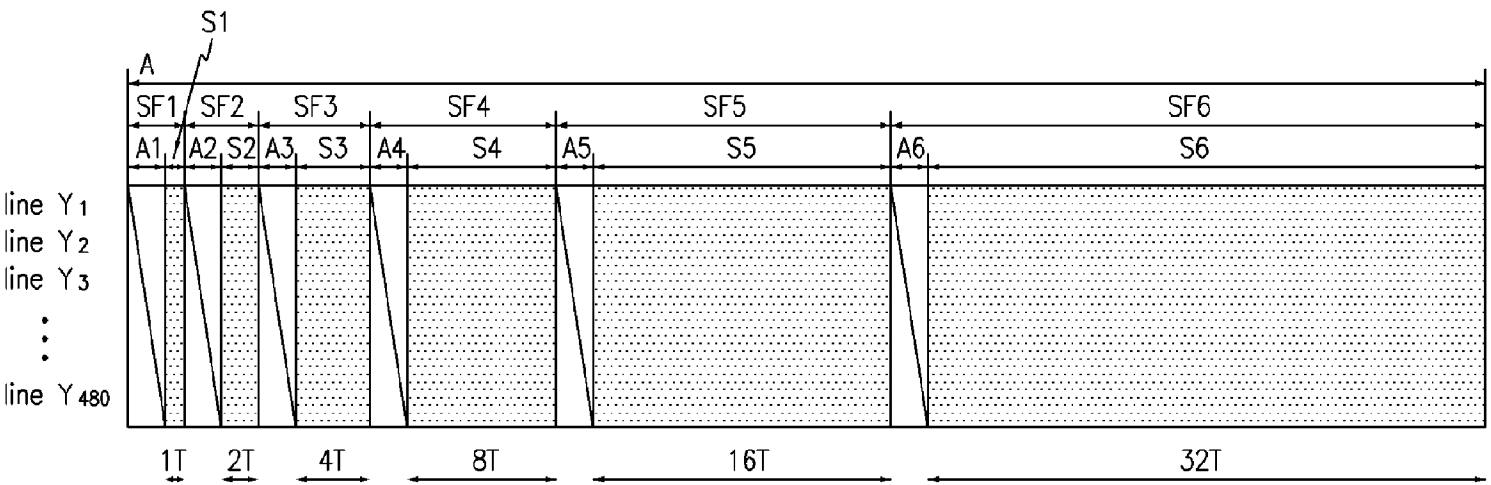
FIG.2 Conventional Art
FIG. 2 shows a method for realizing gray in a PDP.
Figure 3:
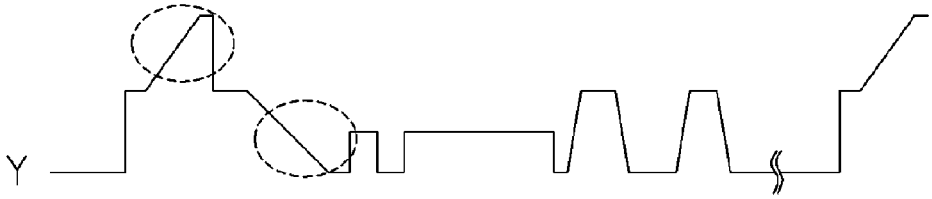
FIG.3 Conventional Art
FIG. 3 shows a PDP driving waveform using a ramp pulse.
Figure 4:
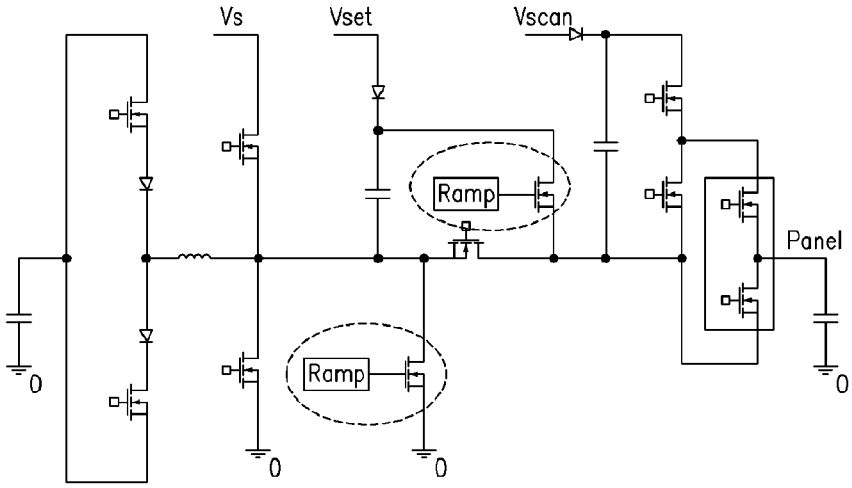
FIG.4 Conventional Art
FIG. 4 shows a PDP driving circuit for the driving waveform of FIG. 3.
Figure 5:
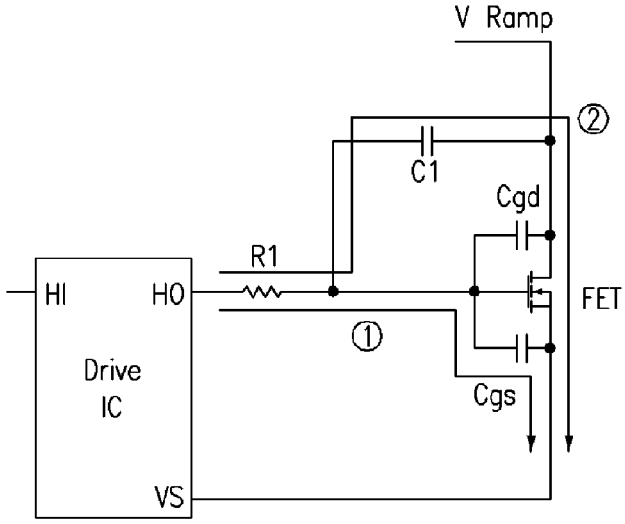
FIG.5 Conventional Art
FIG. 5 shows a ramp pulse generation circuit using a capacitor.
Figure 6:
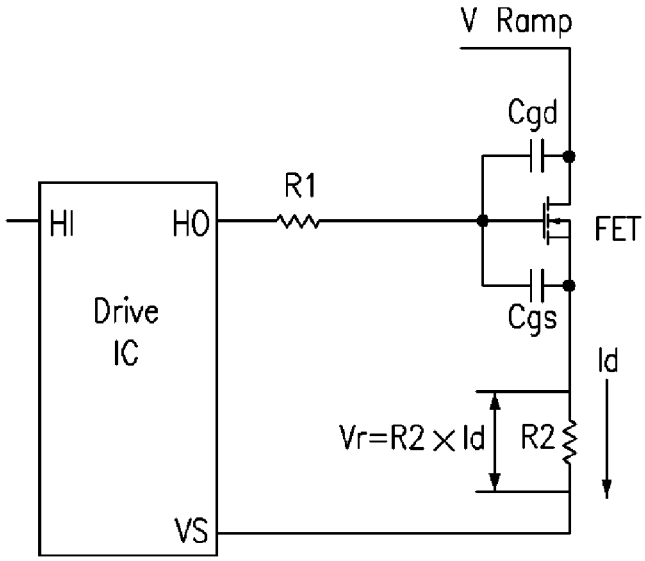
FIG.6 Conventional Art
FIG. 6 shows a ramp pulse generation circuit using a resistor.
Figure 7:
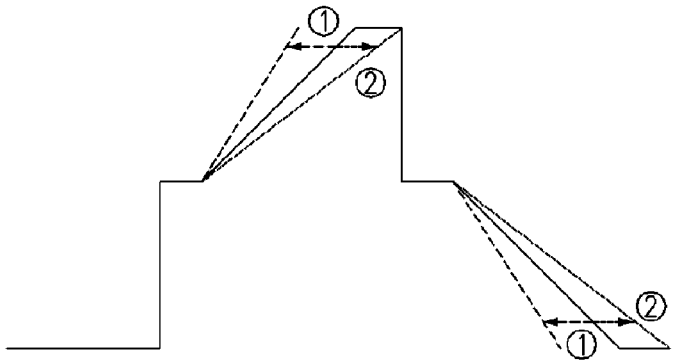
FIG.7 Conventional Art
FIG. 7 shows gradients of the ramp pulse of FIGS. 5 and 6.

In general, the characteristics of the resistor R1 vary little according to temperature, but the capacitor varies remarkably according to temperature changes compared to the resistor, and the variable values following the temperatures of the parts are shown in data sheets in a graph format in FIG. 7.

Since the capacitor C_positive has a negative temperature characteristic, the gradient of the ramp pulse further decreases at a high temperature according to temperature changes (i.e., the direction of arrow 2 in FIG. 7), and it further increases at a low temperature(i.e., the direction of arrow 1 in FIG. 7).

When the capacitor C_positive is coupled in parallel to the capacitor C_negative, temperature compensation can be possible by using a characteristic that the capacitance of a part increases as the temperature rises because of the negative temperature characteristic of the capacitor C_positive.

Figure 9:
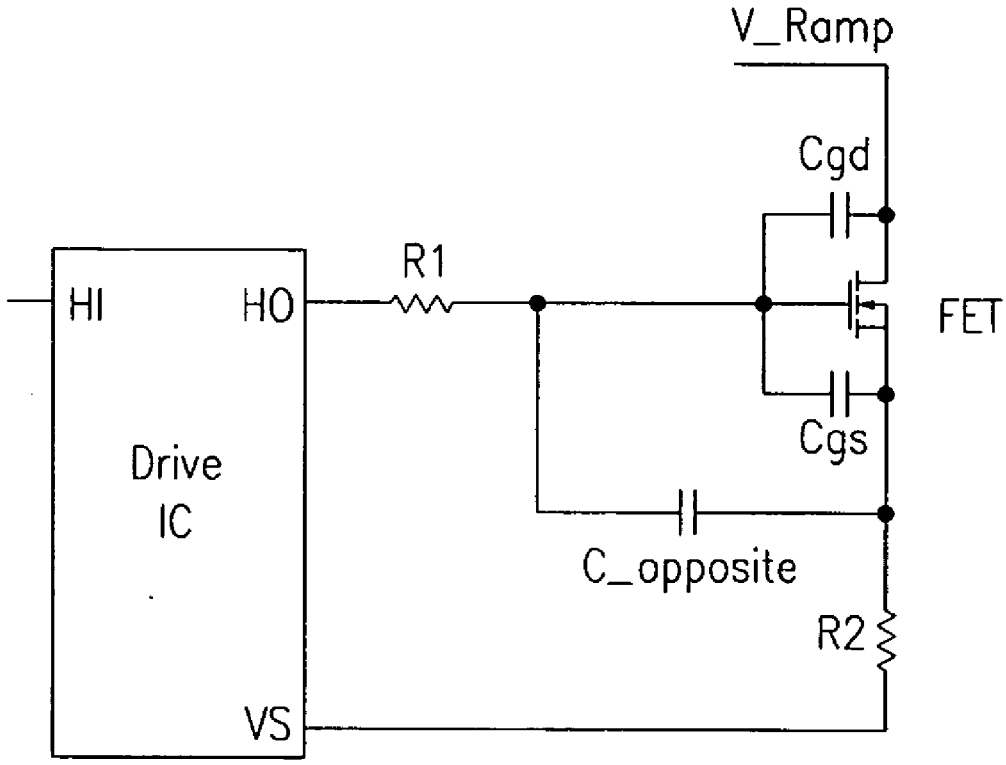
FIG. 9 shows a PDP driving circuit according to a second exemplary embodiment of the invention.

FIG. 9 shows a PDP driving circuit according to a second exemplary embodiment of the invention.

As shown in FIG. 9, the PDP driving circuit having a resistor R2 between a source of a FET and a terminal Vs of a driving IC generates a ramp pulse. A capacitor C_opposite, having a temperature characteristic opposite to the temperature characteristic of the parasitic capacitor Cgs between the gate and the source of the FET, is coupled between the gate and the source of the FET.

Gradient variation of the ramp pulse following changes of the parasitic capacitor Cgs is controlled by installing the capacitor C_opposite, in consideration of the temperature characteristics of the FET.

In this instance, the PDP driving circuit according to the second exemplary embodiment can more accurately compensate for the temperature by coupling an external capacitor between the gate and the drain of the FET, the temperature characteristic of the external capacitor is opposite to that of the parasitic capacitor between the gate and the drain of the FET.

In this case, since the parasitic capacitor Cgd of the FET is very small compared to the parasitic capacitor Cgs, it is possible to additionally install an external capacitor with a temperature characteristic opposite to that of parasitic capacitor Cgd when very precise temperature compensation is needed.

Figure 10:
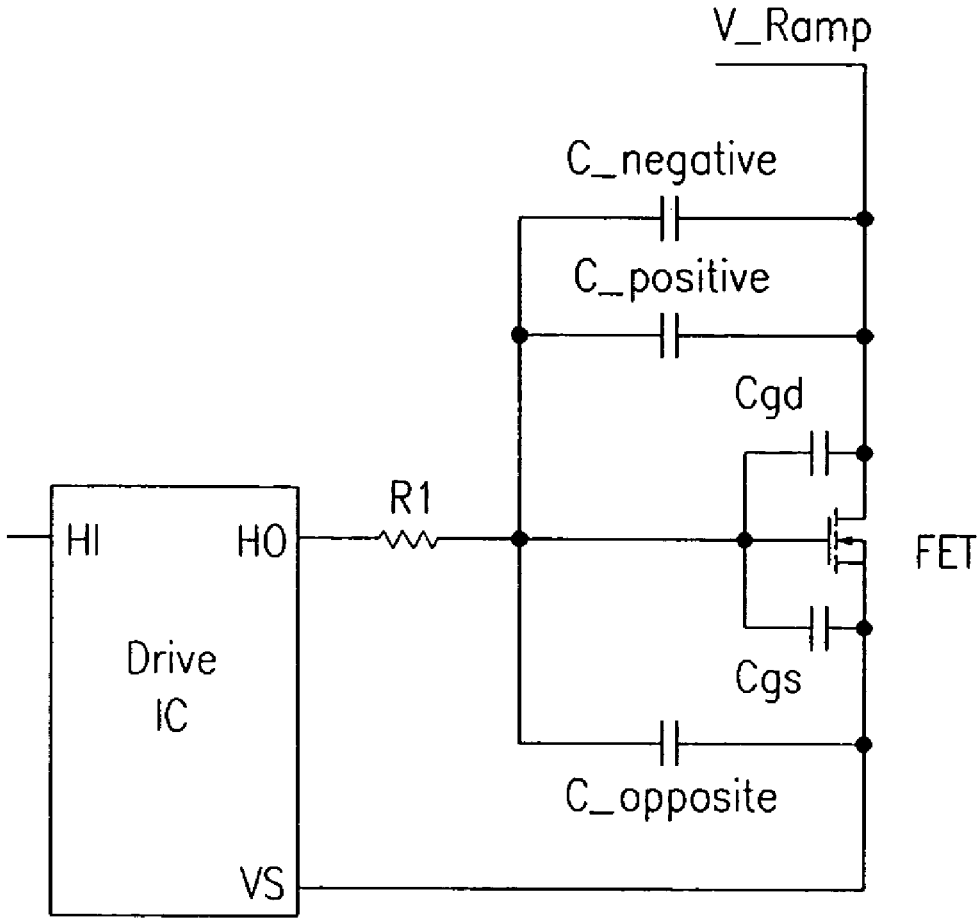
FIG. 10 shows a PDP driving circuit according to a third exemplary embodiment of the invention.

FIG. 10 shows a PDP driving circuit according to a third exemplary embodiment of the invention.

As shown in FIG. 10, capacitors C_negative and C_positive with opposite temperature characteristics are coupled in parallel between the gate and the drain of the FET. A capacitor C_opposite with a temperature characteristic opposite to that of the parasitic capacitor Cgs of the FET is coupled between the gate and the source of the FET so as to more precisely control the gradient variation of the ramp pulse in view of temperature.

Further, more precise temperature compensation can be executed by coupling an external capacitor having a temperature characteristic opposite that of the parasitic capacitor Cgd of the FET between the gate and the drain of the FET.

In addition to the above-described exemplary embodiments, the temperature compensation can be considered in connection with panel temperature characteristics of the PDP.

If a panel's temperature characteristic is positive, capacitance of the panel rises at higher temperatures to reduce the gradient of the ramp pulse, and accordingly, the gradient of the ramp pulse can be compensated by installing a capacitor with a negative characteristic for generating a ramp pulse in the PDP driving circuit.

The PDP driving circuit according to this invention couples parts with opposite temperature characteristics in parallel so that values of the parts for generating a ramp pulse may not be varied according to temperature changes. Thus, it is possible to prevent gradient charges of the ramp pulse to acquire stable operation of the ramp pulse.

The PDP driving circuit according to this invention maintains the gradient of the ramp pulse according to the temperature, thereby improving an operational margin of the PDP and preventing low-temperature and low-discharging phenomena.

While this invention has been described in connection with what is presently considered to be the most practical embodiment, it is to be understood that the invention is not limited to the disclosed exemplary embodiments. On the contrary, the invention is intended to cover various modifications and equivalent arrangements included within the spirit and scope of the appended claims.

What is claimed is:

1. A plasma display panel driving circuit for generating a ramp pulse for linearly increasing or decreasing a panel capacitor voltage of a plasma display panel, comprising:

a transistor in which at least one parasitic capacitance is formed;

a negative feedback element coupled to the transistor, for performing negative feedback control on a voltage charged in the parasitic capacitance so that the transistor may operate as a constant current source; and a first capacitor coupled between a gate and an active node of the transistor, the first capacitor having a temperature characteristic opposite to a temperature characteristic of the negative feedback element.

2. The plasma display panel driving circuit of claim 1, wherein the first capacitor is coupled between the gate and a drain of the transistor, and the negative feedback element comprises a second capacitor, coupled in parallel with the first capacitor, between the gate and the drain of the transistor.

3. The plasma display panel driving circuit of claim 2, further comprising a third capacitor coupled between the gate and a source of the transistor, the third capacitor having a temperature characteristic opposite to a temperature characteristic of the parasitic capacitance formed between the gate and the source of the transistor.

4. The plasma display panel driving circuit of claim 2, further comprising a third capacitor coupled between the gate and the drain of the transistor, the third capacitor having a temperature characteristic to opposite that of a temperature characteristic of the parasitic capacitance formed between the gate and the drain of the transistor.

5. The plasma display panel driving circuit of claim 2, further comprising a third transistor coupled in parallel to the parasitic capacitance of the transistor, and having a temperature characteristic opposite to a temperature characteristic of the parasitic capacitance.

6. The plasma display panel driving circuit of claim 1, wherein the negative feedback element comprises a resistor coupled to an output end of the transistor, and the first capacitor is coupled between the output end of the transistor and the gate of the transistor.

7. A plasma display panel driving circuit for generating a ramp pulse for linearly increasing or decreasing a panel capacitor voltage of a plasma display panel, comprising:

a transistor having parasitic capacitance formed between a gate and a source thereof;

a first capacitor coupled between the gate and a drain of the transistor; and a second capacitor coupled between the gate and the drain of the transistor, the second capacitor having a temperature characteristic opposite a temperature characteristic of the first transistor.

8. The plasma display panel driving circuit of claim 7, further comprising a third capacitor coupled between the gate and a source of the transistor, the third capacitor having a temperature characteristic opposite to a temperature characteristic of the parasitic capacitance.

9. A plasma display panel driving circuit for generating a ramp pulse for linearly increasing or decreasing a panel capacitor voltage of a plasma display panel, comprising:

a transistor having a parasitic capacitance formed between a gate and a source thereof; and a first capacitor coupled between the gate and the source of the transistor, the first capacitor having a temperature characteristic opposite to a temperature characteristic of the parasitic capacitance.

10. The plasma display panel driving circuit of claim 9, further comprising a second capacitor coupled between the gate and a drain of the transistor.

11. The plasma display panel driving circuit of claim 10, further comprising a third capacitor coupled between the gate and the drain node of the transistor, the third capacitor having a temperature characteristic opposite to a temperature characteristic of the second transistor.

12. The plasma display panel driving circuit of claim 10, further comprising a resistor coupled to the source of the transistor.

* * * * *